United States Patent [19]

Güthoff

[11] Patent Number: 4,639,183

[45] Date of Patent: Jan. 27, 1987

[54] BUCKET EXCAVATOR

[75] Inventor: Wilfred Güthoff, Witten, Fed. Rep. of Germany

[73] Assignee: Friedrich Wilh. Schwing GmbH, Herne, Fed. Rep. of Germany

[21] Appl. No.: 716,582

[22] Filed: Mar. 27, 1985

[30] Foreign Application Priority Data

Mar. 30, 1984 [DE] Fed. Rep. of Germany ..... 3411866

[51] Int. Cl.[4] ..... E02F 5/02

[52] U.S. Cl. ..... 414/705; 414/723; 37/103

[58] Field of Search ..... 414/705, 723, 694; 37/103, 117.5, DIG. 19

[56] References Cited

U.S. PATENT DOCUMENTS

| | | | |
|---|---|---|---|
| 3,896,950 | 7/1975 | McCain | 414/705 X |
| 3,985,249 | 10/1976 | Aker et al. | 414/723 |
| 4,251,181 | 2/1981 | Drott et al. | 414/723 |
| 4,253,793 | 3/1981 | Braml | 414/723 |
| 4,277,899 | 7/1981 | Guthoff | 37/103 |
| 4,397,604 | 8/1983 | McCain | 414/705 X |

*Primary Examiner*—Terrance L. Siemens

*Attorney, Agent, or Firm*—Kinney & Lange

[57] ABSTRACT

An improved bucket connection apparatus is provided in a bucket excavator whose working implement is connected to the bucket arm with an operating hinge and whose drive consists of a pair of working cylinders attached on either side of the operating hinge axis. The operating hinge is attached to a clamp that has two clamping feet, with at least one foot being movable about a clamping hinge axis which coincides with the operating hinge axis. The movable clamping foot is connected on the outside with one of the two working cylinders, and, on the insides, it is constructed as a gripper opposing the other clamping foot, for engaging connections (such as upstanding bolts) provided on the associated working implement for the purpose of attaching the operating hinge. The connections cooperate with the clamping feet to provide a locking arrangement that is effective when the clamping feet are in their gripping position.

6 Claims, 10 Drawing Figures

BUCKET EXCAVATOR

BACKGROUND OF THE INVENTION

1. Field of the Invention.

The invention concerns a bucket excavator whose working implement (e.g. a bucket) is pivotally connected to a bucket arm with an operating hinge and which has a drive consisting of a pair of cylinders on opposite sides of the operating hinge axis to rotate the implement about that axis.

Accordingly, the bucket excavator in accordance with the invention is a single-scoop excavator whose digging scoop is preferentially constructed as a bucket that can be exchanged for another bucket. The excavator in accordance with the invention can, moreover, be designed as a universal excavator in order, other than with different buckets, to also be equipped with other working equipment, e.g. a pile driver or a similar apparatus. Preferentially, however, the invention is realized as a precision excavator that displays a straight line guidance of its bucket in the scraping plane; therefore, the invention will be described in the following with the the aid of an excavator of this type.

2. Description of the Prior Art.

In the case of bucket excavators, the bucket arm most often sits at the tip of the split-up boom, whereby the parts are connected to one another over operating hinges with hinge axes that run transversely to the perpendicular plane of rotation of the boom, as well as being actuated by means of double-acting working cylinders, the drive for which is generally hydraulic. Here, the digging tool is connected on one side with an operatng hinge at the tip of the bucket arm and has its own operating cylinder that is connected, in the case of precision excavators, to the boom. The pivoting movement of a bucket serving as a digging took about the axis of the operating hinge located at the end of the bucket arm serves for filling and emptying the bucket and additionally functions for setting the angle of cut of the bucket blade and/or of the ripping teeth attached thereon.

The kinematics of a bucket excavator of the type just discussed requires that the plane of the bucket running transversely to the boom and/or the bucket blade run parallel to the ground level plane of the excavator, provided no correction capability is built in. Although it is basically possible to construct the caterpillar or wheel travel mechanism of the excavator to be pivotable relative to the top carriage, or to build in a correcting linkage in order to be able to adjust the cutting plane of the excavator independently of the ground level plane of the lower carriage, it is particularly advantageous to incorporate a correction linkage with the hinge axis lying in the perpendicular plane of rotation of the boom between the bucket and the bucket arm. The drive for the linkage is split-up between the two working cylinders that are disposed on either side of the hinge pin. This common arrangement of the working cylinders, also in the case of other operating hinges, enables dividing the pivoting forces between the two operating cylinders which, in this fashion, are given comparably smaller dimensions. It additionally has the advantage of a lesser bearing loading in the operating hinge. The invention relates in particular to the operating hinge that immediately adjoins the bucket and, therewith, preferentially on the correction linkage described, for the purpose of altering the scraping plane relative to the ground level plane of the lower carriage of the excavator, which is preferentially provided on the precision excavators.

Excavators performance can be optimized by incorporation of different digging scoops. In the case of loose, light earths, a large volume bucket can provide the best working results, while in rocky ground a smaller, but stronger, bucket will be required. Because of the good steering properties, precision excavators are particularly suited for making ditches (trenches). For this purpose, one advantageously makes use of a bucket whose profile corresponds to the ditch profile. If one makes use of the excavator for planing, particularly favorable then are wide and, most often, flat buckets. Even if an excavator of this type is not outfitted with other working equipment, simply because of the different buckets alone, the working equipment must be changed more frequently. Then, optimizing of the performance of the excavator depends on the timely replacement of the working equipment and, therewith, upon whether the replacement can be carried out rapidly, and without special expense for power, inasmuch as possible alone by the excavator operator.

If for this purpose one installs components of excavator mechanics, e.g. constructs the bolts of the operating hinge separately and capable of being actuated hydraulically for release and/or for gripping the hinge housing or casing, there then results an additional hydraulic drive that is difficult to adapt into the hydraulic supply and control of the excavator. Additionally, the operating hinge will be complicated and the replacement of the working implement will be difficult for the excavator operator. If, on the other hand, one makes provision for incorporating a mechanical coupling between the bucket and the operating hinge for replacement of the working implement, the parts of which one brings together or releases from one another by swinging the excavator boom, then a hydraulic coupling locking means must be integrated into the hydraulics of the excavator if the excavator operator is to undertake replacement of the working implement alone. This presents practically the same difficulties as an addditional hydraulic drive. The coupling mechanism additionally presumes that each working implement will be outfitted with a coupling half, which is relatively more expensive than separating the hinge bolt.

The invention is an improvement upon the precision excavator shown in German patent application DE-OS No. 28 51 942 and U.S. Pat. No. 4,277,899, because, in the case of that bucket excavator, the operating hinge adjoining the bucket represents a correction linkage within the idea explained above, which is actuated by two working cylinders. If the working implement is to be replaced, the operating hinge must be disassembled in order, after disconnecting the piston rods of the working cylinders from the bucket brackets, to release the bucket arm for replacement. Just as expensive is mounting the bucket or another working implement that is to be exchanged for the disassembled bucket.

The use of known mechanisms for simple replacement of the working implement of an excavator of this type already founders due to the fact that this changes the height of the operating hinge above the digging (ditching) tool so strongly that straight line guidance of the bucket is lost. In the case of the precision excavators, this straight line guidance is achieved by fine-adjustment of various linkage parallelograms, into which the parts of the boom and of the working cylinders articulated to a pivoting lever of the bucket are drawn. In general, in the case of a precision excavator, the above described remaining disadvantages of these known mechanisms would also take on particularly great importance.

The task underlying the invention is to enable replacement of the working implement on a bucket excavator and, in so doing, to construct the required mechanisms and their drives simply and such that they do not disturb the straight line steering of a precision excavator of the prior art and, in the case of other bucket excavators, to enable retaining the hydraulic drive without essential alteration of the hydraulic system with only negligibly changed attaching means for the working implement, whereby only few and inexpensive parts remain on the working implement that has been replaced.

SUMMARY OF THE INVENTION

According to the invention, the drive for the operating hinge (i.e. used for actuation) is a mechanism for both working cylinders that is required for correction of the bucket, which remains continuously at the tip of the bucket arm and that includes the entire operating hinge. Since, in accordance with the invention, this mechanism is constructed as a clamp, it can grip the connections necessary for connection of the operating hinge to the bucket and/or another type of working implement, which remain as individual, but particularly simple components on the operating hinge. Locking is then still required only for the clamping feet and, indeed, for the time period of use of the working implement in question on the excavator.

The invention has the advantage that, by integration of the clamping foot into the operating hinge, the height of the hinge connection of the working implement is practically unchanged and, in this fashion, in the case of the precision excavator, does not allow premature degeneration and/or complete elimination of straight line steering of the bucket. Since, in accordance with the invention, one makes use of the working cylinders for actuating the clamps, one does not need to change either the hydraulic control of the excavator or the hydraulic system for supplying the various operating cylinders. It follows, therefore, that the excavator operator can actuate the clamp and carry out the replacement of the working implement from the excavator. Since the clamp can also be maintained closed with at least one working cylinder of the operating hinge, locking can be accomplished mechanically without any disadvantage and can, therefore, among other things, also consist of a simple bolt arrangement.

Preferably, the bucket excavator of the invention is further characterized by the fact that, for the purpose of changing of the working implement, the operating hinge is disconnected by blocking the working cylinder associated with a fixed clamping foot and that the operating cylinder connected to the movable clamping foot serves for opening and closing the gripper. Alignment of the clamps and their actuation can be simplified for the excavator operator with these features, because, by blocking the operating hinge with one working cylinder, the clamping foot associated thereto is held in fixed fashion and the gripping movement is executed only with the other clamping foot.

Also preferably, the bucket excavator is further characterized by the fact that the operating hinge is attached at a top side to a mounting plate that is split up by a clamping hinge joint, in mirror symmetrical fashion to form the two clamping feet, said mounting plate having on its top side conection brackets for the working cylinders and, at hinge joint edges of its clamping feet openings for cooperating with one another in the gripping position to engage the connections which comprise projections from the working implement which are provided with heads. Resulting from these features is a particularly flat-forming overall arrangement, wherewith the height of the closed clamping foot is reduced to the thickness of the mounting plate, which is indispensible for the straight line steering of a precision excavator. Additionally, the connectors remaining on the working equipment in question are reduced to simple projections, e.g. to bolts with flat-shaped heads.

The bucket excavator also preferably is characterized by the fact that a hinge pin of the operating hinge forms a hinge joint axis of the mounting plate and that the operating hinge is divided and also attached to the two clamping feet. With theses features, it is possible to combine in particularly simple manner the hinge joint of the mounting plate with the operating hinge. By having the operating hinge divided and including with each half, brackets of the working cylinders that are split up in mirror symmetrical fashion, transversely to a clamping hinge joint, a favorable distribution of the forces on the housing of that operating hinge is achieved.

If the excavator operator holds the boom and the bucket arm inwardly such that he has the working implement directly in his field of vision, he can, as a rule, without further ado, i.e. without special auxiliary means, set the movable clamping foot into the track in the connectors of the working equipment to be replaced. In practice, however, this is not always possible. Frequently, however, the operating equipment is located at a great distance from the cab of the excavator and this must be achieved by expanding the boom.

Mounting of the working implement is essentially simplified by a guiderail which is spaced from the connections, is attached on the working implement and, in preparation for gripping, cooperates with the fixed clamping foot to orient in the clamp in alignment with the connections. The operator, when pivoting the upper carriage in preparation for gripping, can use the guiderail as a stopping point for reaching the initial position of the clamp, which needs to be achieved for setting the movable clamping foot into the track without error.

DETAILED DESCRIPTION OF THE PREFERRED EMBODIMENTS

Figure 1:
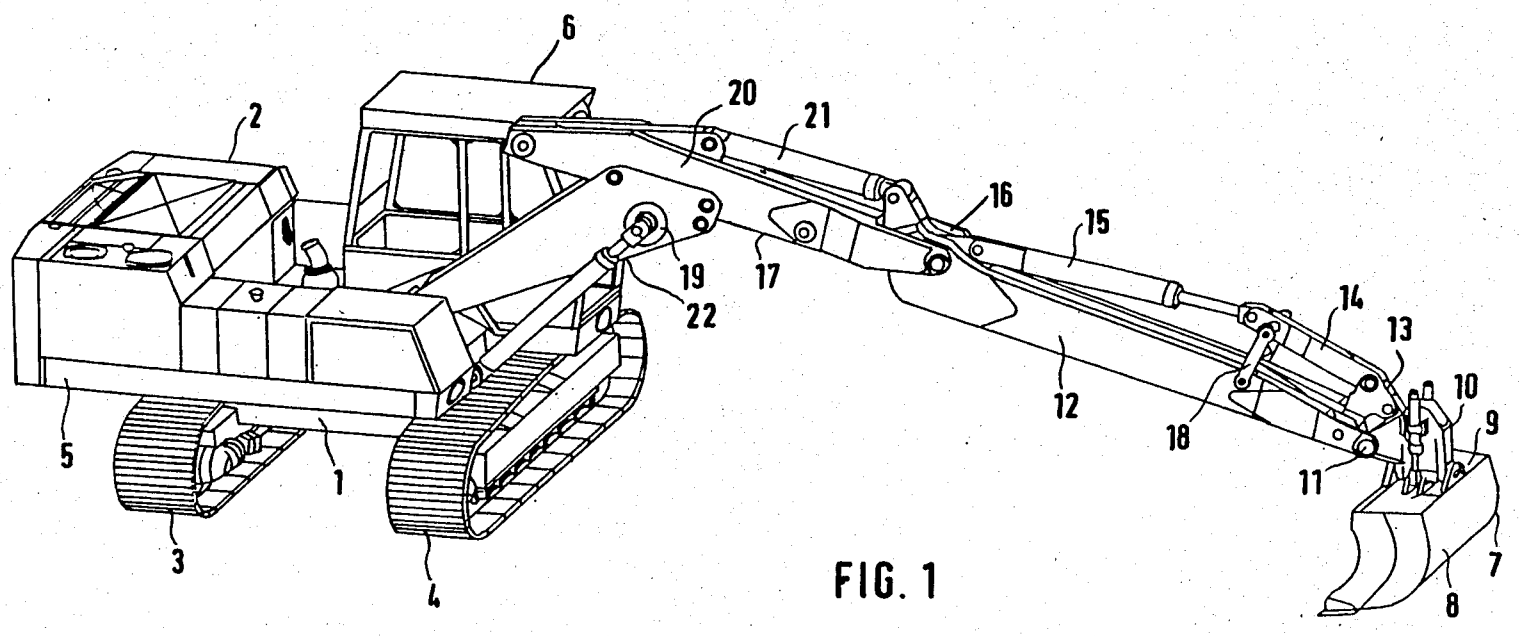
FIG. 1 is a perspective illustration of the invention in its use on a precision excavator.

The lower carriage 1 of excavator 2 rests on two caterpillar tracks 3 and 4, respectively. A top carriage 5, pivotable about a king pin on the lower carriage 1, carries the usual supper structures, among them an operator's cab 6 that enables observation of the working equipment (or implement) 7 and from which the excavator is controlled. The digging tool of the working equipment 7 consisting of a bucket 8 is connected, over an operating hinge 9, to a top part 10, which is illustrated in more detail in FIG. 1. The top part 10 is mounted on an operating hinge 11 that is disposed at the tip of the bucket arm 12. A rocking lever 13 is connected through a linkage to the top part 10, and over a linkage 14 to the piston rod of a working cylinder 15 which, in turn, is attached to the tip 16 of the boom 17. The linkage 14 is supported via a double compensating lever 18, on the bucket arm 12.

The boom is, in turn, divided into a rocking arm 19, articulated on the top carriage 5, and a boom end-piece 20. Serving to actuate the boom is a double cylinder thrust drive that is designated in general fashion as 22. The bucket arm 12 is swung with a working cylinder 21.

Figure 2:
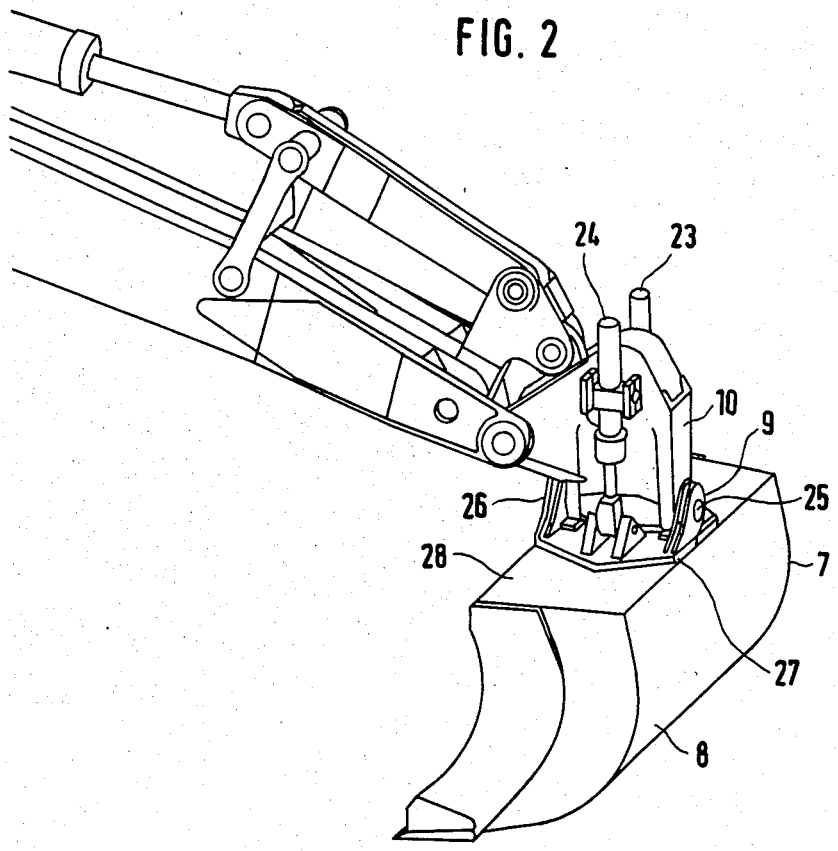
FIG. 2 is a broken-out illustration of a forward end of the precision excavator according to FIG. 1.
Figure 3:
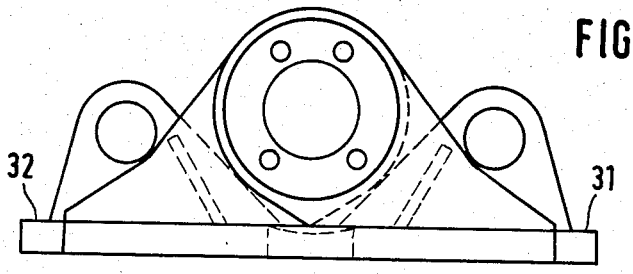
FIG. 3 shows a mounting plate according to the invention, in a front view.
Figure 4:
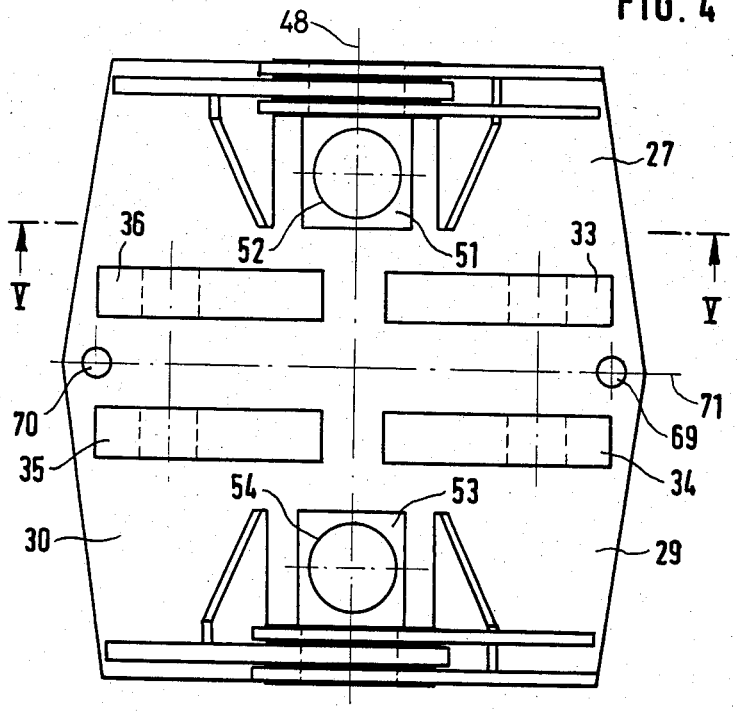
FIG. 4 shows a top view of the plate of FIG. 3.
Figure 5:
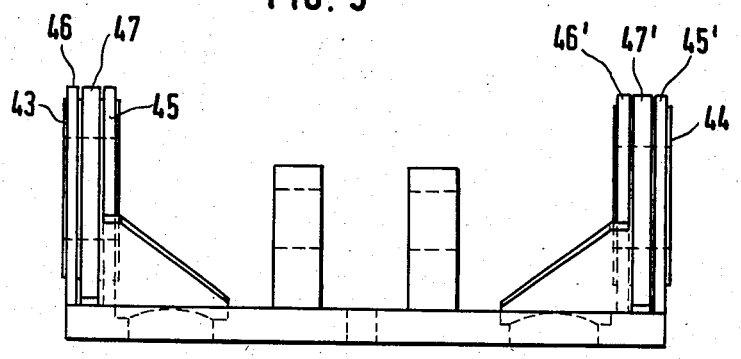
FIG. 5 shows the plate in a side view and in sectional view along line V—V of FIG. 4, respectively.
Figure 5A:
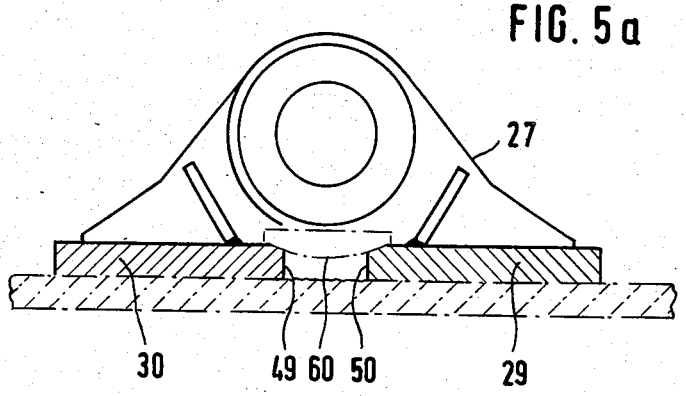
FIG. 5*a* is a sectional view along line V—V of FIG. 4.

According to FIG. 2, the top part 10 serves for mounting the two working cylinders 23, 24, which together form the drive for the operating hinge 9, which is disposed between the bucket 8 forming the working equipment 7 and the bucket arm 12. The operating hinge 9 consists of a hinge pin 25 and of the hinge housing or casing that is designated in general fashion as 26, and will be explained in more detail further below. The hinge housing 26 is disposed on a mounting plate 27 which, in turn, is joined with the top, flat section 28 of the floor of the bucket 8.

The details of the mounting plate can be seen from the illustration of FIGS. 3 to 5*a*. The mounting plate is split up in mirror symmetrical fashion by a hinge joint into two clamping feet 29, 30. The clamping feet display on their top sides 31, 32, respectively, the connector brackets 37, 38 (FIG. 6), consisting of two parallel fork legs 33, 34, and 35, 36, respectively, that join the mounting plate 27 with the piston rods 39, 40 of the pistons 41, 42 in the working cylinders 23, 24. Additionally located on the top side 31, 32 of the clamping feet 29, 30 are the parts, one-half each 43, 44 of the hinge housing 26. Both hinge halves are constructed identically. They consist of a bracket split into two fork tines 45, 46 that are mounted on the top side 31 of the clamping foot 29, and of another bracket 47 that is disposed on the top side 32 of the clamping foot 30. Corresponding parts of the half 44 are designated by the same reference numbers which, however, for differentiation bear an index mark. Located in the brackets 46 to 47 and 46' to 47', respectively, are aligned openings through which the pins 25 of the operating hinge 9 can be introduced. This pin then simultaneously forms the hinge pin of a hinged joint about which the clamping feet 29 and 30 can be pivoted. the geometric axis 48 of the operating hinge 9 therefore coincides with the axis of the clamping hinge joint.

The inner hinge joint edges 49, 50 of the clamping feet 29, 30 are provided with half-round openings 51 to 54. Two each opposed openings 51, 52, respectively 53, 54 cooperate with bolts 56, 57 which project perpendicularly upwardly from the top side of the bucket floor 28, which have square, horizontal plates 58, 59, respectively, as their bolt heads. The underside of the bolt heads 58, 59 are illustrated at 60 in FIG. 5 and are convexly curved in order to enable play-free engagement of the connections formed by the bolts 56, 57 with the clamping feet 29, 30.

Figure 7:
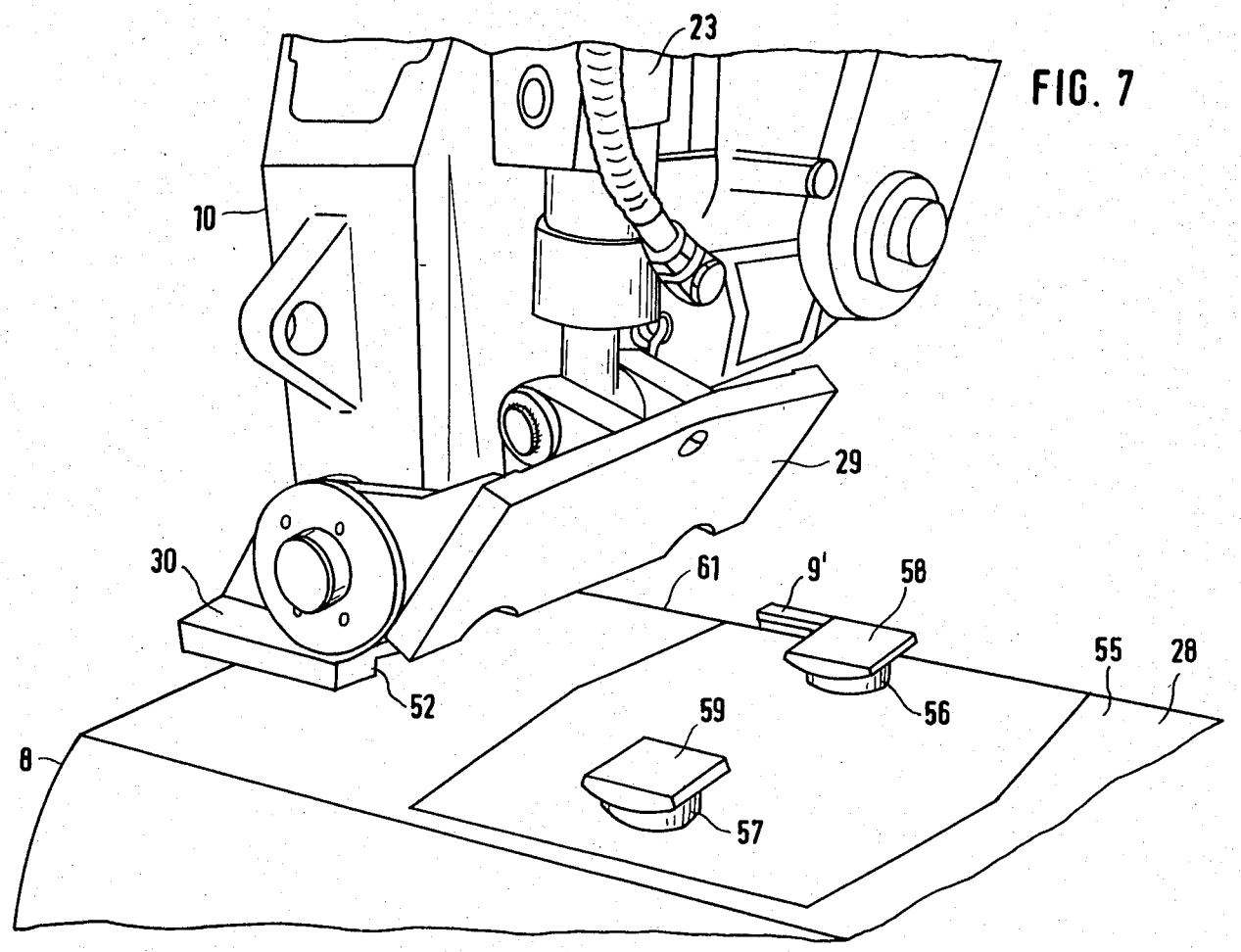
FIG. 7 is a perspective representation showing a first phase when mounting a bucket.

As is particularly shown in FIG. 7, disposed on the front side 61 of the bucket 8 facing toward the excavator operator in cab 6 is a guiderail 9'. Its function will be explained in more detail in conjunction with the method of operating of the clamping feet 29, 30.

Figure 6:
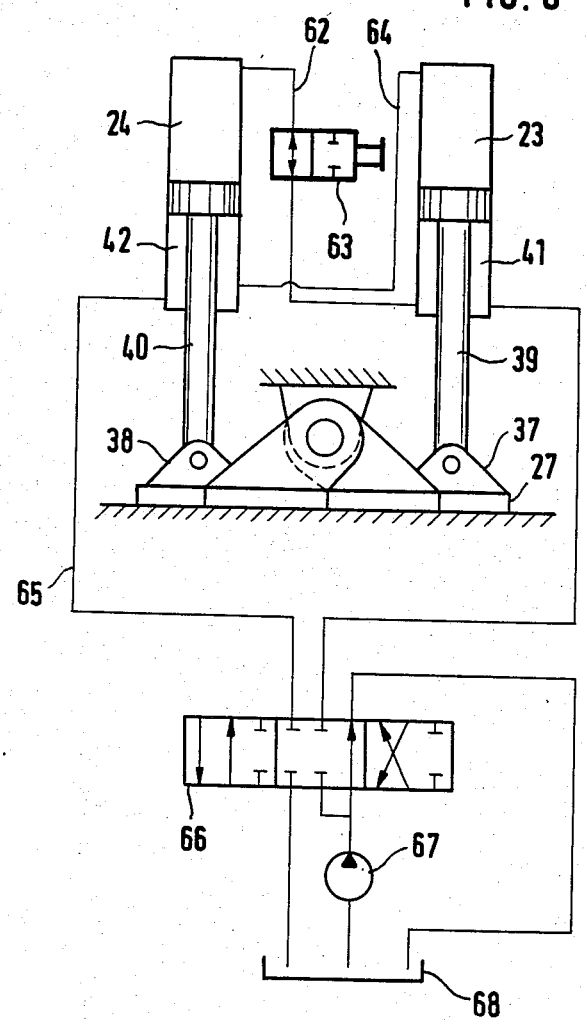
FIG. 6 is a schematic diagram showing the working cylinders and their circuit and control, respectively.

As is shown in the illustration in FIG. 6, installed in line 62 of the working cylinder 24 is a 2/2-directional control valve 63 that can be actuated by a manual push-button 64. The line 62, as well as the line 65 for the working cylinder 23, is controlled with a control valve 66. This valve is located between the pump 67 serving to supply oil and the supply tank 68 which, in the position of the directional control valve 66 illustrated, is switched over to circulation so that both working cylinders 23, 24 are blocked. By shifting the directional control valve 66, the cylinders are alternately actuated upon, provided that the directional control valve 63 is in the illustrated position. It is possible in this manner to correct the scraping plane relative to the ground level plane of the excavator. If the directional control valve 63 is reversed, the working cylinder 24 is then blocked. This normally happens in approximately the horizontal position of the mounting plate 27, as illustrated in FIG. 6. In this position, it is possible to control further only the piston 41 of the working cylinder 23 with the directional control valve 66. This movement is used to open and close the clamping leg.

In the operating position that is shown in FIG. 6, inadvertent opening of the clamping feet 29, 30 by interlocking is excluded. According to the example of embodiment illustrated, additionally serving for this are screws 73 that are introduced into openings 69, 70 of the mounting plate 27 and that penetrate through the floor 28 of the bucket 8.

As is shown, the clamping feet 29, 30 are disposed in mirror symmetrical fashion to the axis 48, and the hinge housing halves 43, 44 as well as the bracket parts 33 to 36 and the openings 69 and 70 are disposed on mirror symmetrical fashion to the transverse axis 71 of the mounting plate 27.

Explained in the following is the mounting of working equipment, using by way of example the working equipment 7. Additionally assumed is that the working equipment that was previously attached to the bucket arm 12 and the top part 10, respectively, has been removed. The bucket 8 lies on the surface of the ground and is here oriented such that its floor 28 is at the top.

Figure 8:
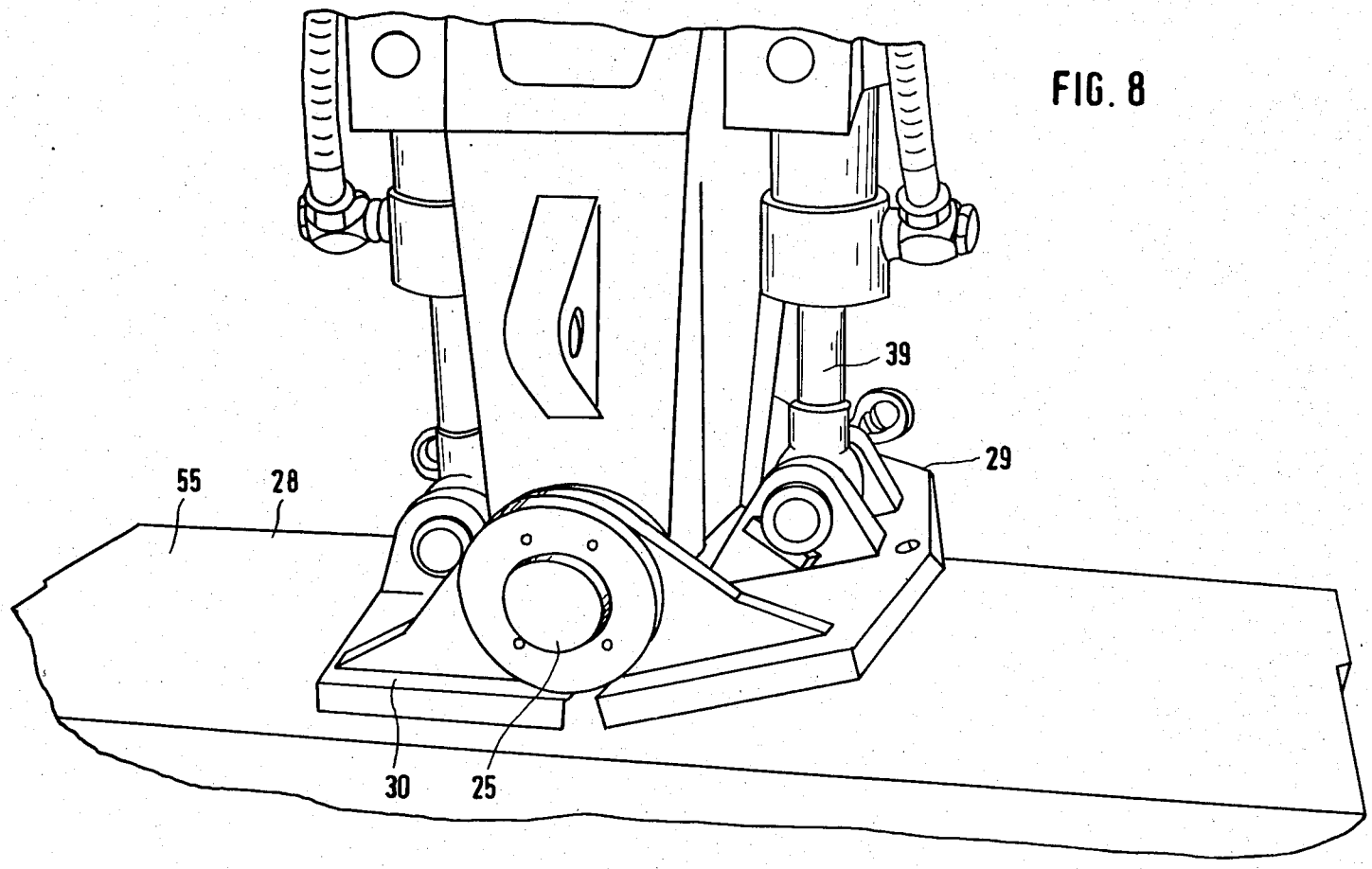
FIG. 8 is a perspective representation showing another phase of mounting of the bucket.

First, the directional control valve is switched over so that the working cylinder 24 is blocked, whereby the clamping leg 38 remains fixed. From the cab 6, the excavator operator now swings the bucket arm 12, and therewith, the top part 10, in accordance with the illustration of FIG. 7, from left to right, whereby the piston rod 39 in the working cylinder 23 is driven inwardly and, corrspondingly, the clamping leg 37 is raised upwardly. The thereby opened clamping feet 29, 30 are therewith prepared for meshing of the clamping feet into the connections. With further swinging of the top part 10 in accordance with FIG. 7, the excavator operator orients himself on the guiderail 9', which cooperates with the forward edge of the clamping foot 30, and indicates to the operator when the half-round openings 52 and 54 under the head plates 58, 59 of the bolts 56, 57 are in the track. This position has already been reached in the illustration of FIG. 8. The clamping foot 30 here lies on the top side 55 of the floor 28.

Piston 41 is driven out further by actuation of the directional control valve, so that the piston rod 39 swings the clamping foot 29 in the clockwise direction about the hinge bolt 25 of the operating hinge 9 that simultaneously forms the axis of the hinged joint. Finally, in this fashion, the half-round openings 51, 53 of the clamping foot 29, as well as, like before, the half-round openings 52, 54 of the clamping foot 30 are on the track in the connections.

Figure 9:
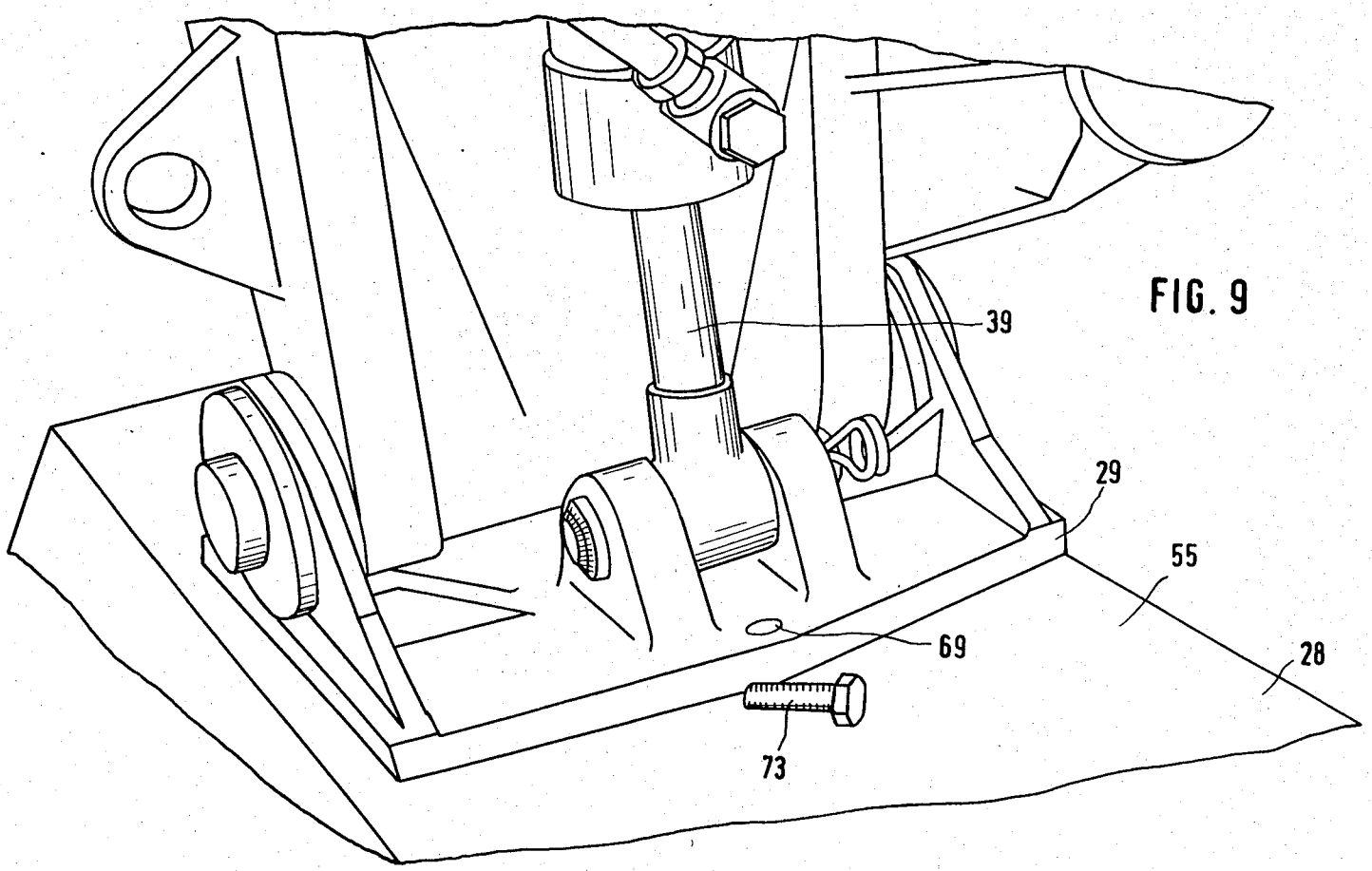
FIG. 9 shows the closed clamp with which mounting of the bucket is carried out.
Figure 10:
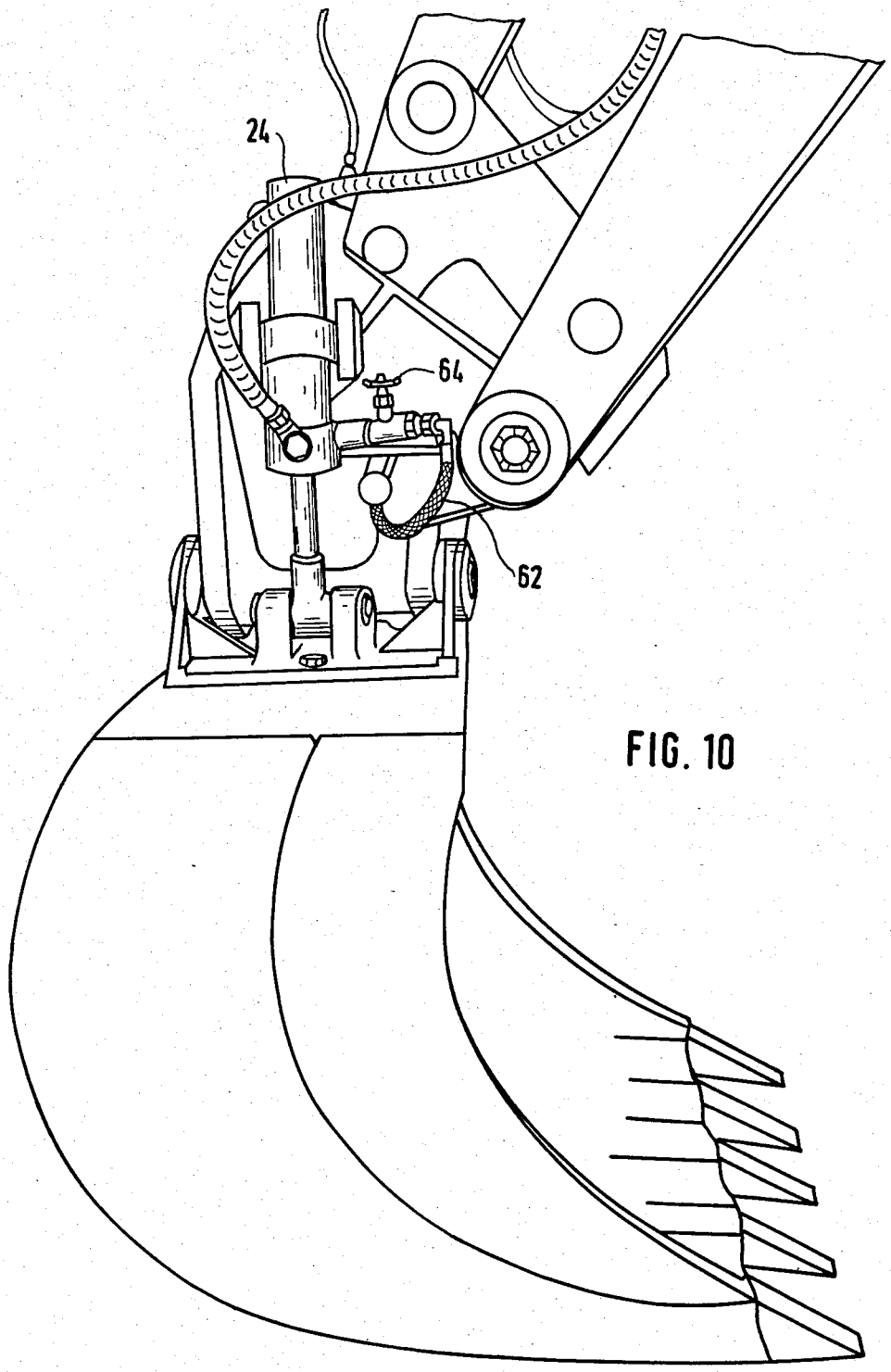
FIG. 10 shows the completely mounted bucket after finishing replacement.

This condition is reached in the illustration of FIG. 9. Here, the clamping foot 29, in turn, lies on the top side 55 of the bucket floot 28. By actuating the directional control valve 66, the operator can block further outtravel of the piston rod 29 and leave the cab. Then, he rotates screws 73 into the openings 69, 70 of clamping feet 29, 30, respectively, which lock the clamping feet 29, 30. With this, the mounting procedure is ended. After the directional control valve 63 has been reversed, it becomes possible to set the working equipment into operation, in accordance with FIG. 10. Disassembly of the working equipment is done in the reverse order.

What is claimed is:

1. A bucket excavator having a working implement which is connected to a bucket arm with an operating hinge for movement about an operating hinge axis, and having a drive which comprising first and second working cylinders attached on opposite sides of the operating hinge axis for moving the working implement about the operating hinge axis; the bucket excavator characterized by the operating hinge being attached to a clamp having first and second clamping feet, at least the first clamping foot being movable about a clamping hinge axis which coincides with the operating hinge axis, the first clamping foot being connected to the first working cylinder, and the first clamping foot opposing the second clamping foot to form a gripper for engaging connections provided on the working implement for attaching the operating hinge to the working implement, said connections cooperating with the clamping feet to provide a locking arrangement when the clamping feet are in a gripping position.

2. A bucket excavator according to claim 1, characterized by the fact that, for the purpose of changing the working implement the operating hinge is disconnected by blocking the second working cylinder which is connected to the second clamping foot and that the first operating cylinder connected to the first clamping foot serves for opening and closing the gripper formed by the first and second clamping feet.

3. A bucket excavator according to claim 1 characterized by the fact that the oprating hinge is attached at a top side to a mounting plate that is divided in mirror symmetrical fashion to form the first and second clamping feet, said mounting plate having on a top side connection brackets for the first and second working cylinders and, at opposing edges of the first and second clamping feet, openings for cooperating with one another when the clamping feet are in the gripping position to engage the connections provided on the working implement which connections comprise projections from the working implement and wherein the projections are provided with heads.

4. A bucket excavator according to claim 3 characterized by the fact that a hinge pin of the operating hinge forms the clamping hinge axis of the mounting plate and that the operating hinge is divided into first and second hinge sections which are attached to the first and second clamping feet, respectively.

5. A bucket excavator according to claim 1 characterized by the fact that the operating hinge is divided into first and second hinge sections and includes, with each hinge section, brackets of the working cylinders that are split up in mirror symmetrical fashion, orthogonally to the clamping hinge joint.

6. A bucket excavator according to claim 1 and further comprising a guiderail which is attached on the working implement in spaced relationship to the connections for cooperating with the first clamping foot to orient in the first clamping foot in a predetermined alignment with the connections.

* * * * *